US005533907A

United States Patent [19]

Kozel et al.

[11] Patent Number: 5,533,907

[45] Date of Patent: Jul. 9, 1996

[54] ELECTRONIC MODULE SOCKET WITH SELF-CLEANING SHORTING CONTACTS

[75] Inventors: Charles A. Kozel, McHenry; Nels G. Pearson, Buffalo Grove, both of Ill.

[73] Assignee: Methode Electronics, Inc., Chicago, Ill.

[21] Appl. No.: 250,279

[22] Filed: May 27, 1994

[51] Int. Cl.[6] ..... H01R 29/00

[52] U.S. Cl. ..... 439/188; 439/637; 200/51.1

[58] Field of Search ..... 439/188, 637; 200/51.1

[56] References Cited

U.S. PATENT DOCUMENTS 5,085,592 2/1992 Sekiguchi ..... 439/188 OR 5,277,607 1/1994 Thumma et al. ..... 439/188 OR 5,366,382 11/1994 Thumma ..... 439/637 X

*Primary Examiner*—Neil Abrams

*Assistant Examiner*—Daniel Wittels

*Attorney, Agent, or Firm*—David L. Newman

[57] ABSTRACT

An electronic module socket is provided having corresponding pairs of contacts wherein the contacts short out and are self-cleaning. A first contact having a semi-circle terminal end portion and a second contact having a J-shaped terminal end portion. The two terminal portions, upon removal of a module, slide past each other in opposite directions. The contacts having board contact points removed from the short out portions of the contacts. The contacts being fabricated in order to provide for gang loading of the contacts within the electronic module socket insulator.

15 Claims, 2 Drawing Sheets

ELECTRONIC MODULE SOCKET WITH SELF-CLEANING SHORTING CONTACTS

BACKGROUND OF THE INVENTION

This invention relates to electrical connectors and, in particular, an electronic module socket having self-cleaning shorting contacts.

Electronic module sockets having contacts which short out upon removal of an electronic module or printed circuit board from between the contacts are common. An electronic module or printed circuit board may be inserted into an electronic module socket between opposed pairs of contacts. The contacts are formed in such a way so that prior to insertion of a module, the opposed pairs of contacts have shorting potions which abut against each other. Upon insertion of the module, the module separates the two opposed pairs of shorting portions and contact the conductors of the board. The shorting area and the module contact area of the contacts of the prior art are generally located in the same position on the contact. Upon removal of the board and contact of the shorting portions of the opposed pairs of contacts, a short out between the contacts occurs, so that the electronic module socket may still be connected in series.

Such shorting contacts have the disadvantage that the contacts fail to short out when a build-up of glass flakes and/or debris from a module gathers on the shorting portions. Such a build-up prohibits the metal-to-metal abutment of the shorting portions of opposite pairs of contacts. It is common for the module being inserted in such electronic module sockets to comprise an epoxy glass board with unfinished chamfered edges. In situations where hundreds of insertions of the module into the electronic module socket occur, glass flakes from the module and/or debris may build-up on the shorting portion of the contacts. Such a build-up inhibits the contacts from shorting out after hundreds insertions of the module.

It is therefore an object of the present invention to provide a shorting contact which avoids the build-up of glass flakes and/or debris at the shorting portions.

It is another object of the present invention to provide contacts which achieve a sufficient normal force to ensure short out and in contacting an inserted module within an electronic module socket.

It is a further object of the present invention to provide shorting contacts which can withstand hundreds of insertions of a module without inhibiting the shorting out feature.

It is another object of the present invention to provide a contact which may be manufactured on a single progressive die.

It is a further object of the present invention to provide contacts which may be loaded to an electronic module socket quickly, inexpensively and uniformly.

It is another object of the present invention to provide contacts which are self-cleaning.

It is a further object of the present invention to provide contacts which at rest are separated sufficiently to avoid the collection of debris therebetween.

SUMMARY OF THE INVENTION

The above objects are provided by an electronic module socket comprising an elongated insulative housing including an elongated central cavity for receiving an electronic module having a plurality of opposed pairs of contacts located along both sides of the central cavity. The contacts are correspondingly and nonuniformly shaped so that upon removal of the printed circuit board from between the corresponding contacts, the terminal ends of the contacts automatically wipe against one another and provide a short out connection area. A first contact includes a mast section attached to a turn back loop section. The turn back loop section is attached to a terminal section having a semi-circular shape. An apex of the semi-circular terminal section of the first contact provides for a point of contact with the corresponding second contact. The terminal section is adjacent to a first module contact area.

The second contact includes a mast section connected to a turn back loop section. The turn back loop section connects to a second module contact section. The second module contact section attaches to a J-shaped terminal section. The terminal section of the second contact includes a flat area for contacting the corresponding apex section of the terminal section of the first contact. The first and second contacts being mounted opposite each other along the length of the electronic module socket insulator. The contacts alternate in their orientation along the insulator.

The first contact includes a first module contact area adjacent the semi-circle section. The second contact includes a second module contact area. The first module contact area is offset from the second module contact area. The first and second contacts include contact tails for throughboard or surface mounting. An alternative embodiment of the invention is provided wherein the insulative housing includes retention members for prohibiting the contacts from shorting out. The contacts are manufactured via a single progressive die.

Short out connection areas of the terminal sections are positioned away from the plane of insertion of the module and do not contact the module upon its insertion.

These and other features of the invention are set forth below in the following detailed description of the presently preferred embodiments.

DETAILED DESCRIPTION OF THE PRESENTLY PREFERRED EMBODIMENTS

Figure 1:
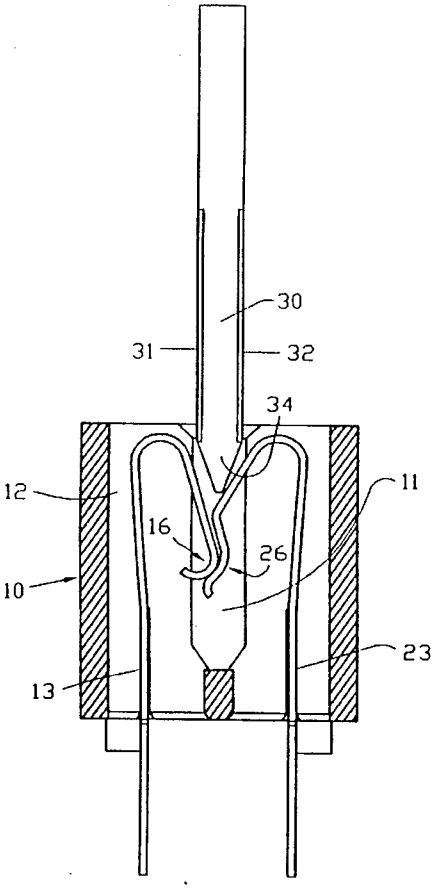
FIG. 1 is a side elevation cut-away view of an electronic module socket prior to insertion of an electronic module.

The present invention relates to an electronic module socket as shown in FIGS. 1–5. FIG. 1 is a side elevation cut-away view of an electronic module socket 10, including an elongated insulator body 12. Mounted in the insulator 12 is first contact 13 and second contact 23. Multiple opposed contacts are mounted along the sides of an elongated central cavity 11, and first contact 13 and second contact 23 will be discussed representatively. The first and second contacts 13,23 have terminal sections 16,26 at which contact is made between the first contact 13 and second contact 23. The contacts 13,23 are shaped so that when at rest, the pairs of corresponding contacts 13,23 are shorted out. This short out feature allows for the contacts to be connected in series.

An electronic module 30 is inserted between contacts 13,23. In a preferred embodiment, the electronic module 30 is a dual read out printed circuit board. The module 30 includes a circuit board having a first conductive surface 31 and a second conductive surface 32. The electronic module 30 is comprised of a substrate of a polymer material. In a preferred embodiment, the electronic module 30 is G-10 epoxy glass. The electronic module 30 includes a chamfered edge 34. The chamfered edge 34 is formed by use of a router or the like on the epoxy glass material. This may leave a rough unfinished edge which creates glass flakes when the chamfered edge 34 is rubbed against a surface.

Figure 2:
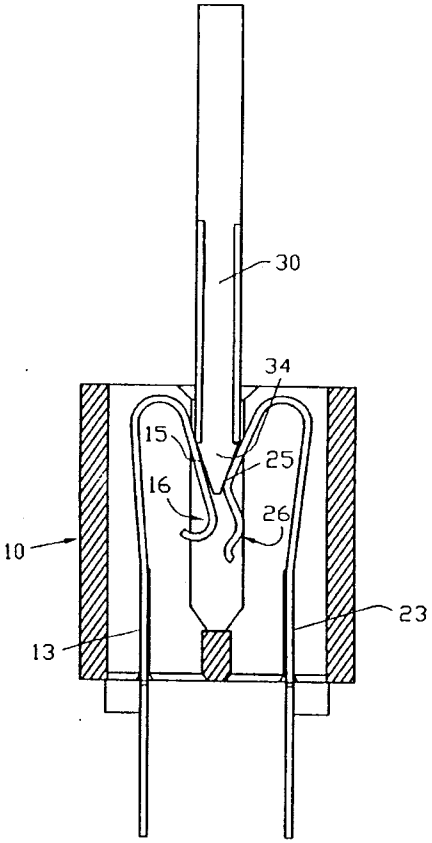
FIG. 2 is a side elevation cut-away view of an electronic module socket during insertion of an electronic module.

FIG. 2 shows the electronic module 30 being inserted between contacts 13,23. As the electronic module 30 is inserted, the chamfered edge 34 abuttingly slides against contacts 13,23 and forces terminal section 16,26 apart. As the electronic module 30 is inserted into the central cavity 11, it slides against the contacts 13,23 and most of the glass flakes from the chamfered edge 34 are removed from the electronic module 30 and become deposited first at the module contact areas 15,25 and to a smaller degree at the terminal sections 16,26 of the contacts 13,23.

Figure 3:
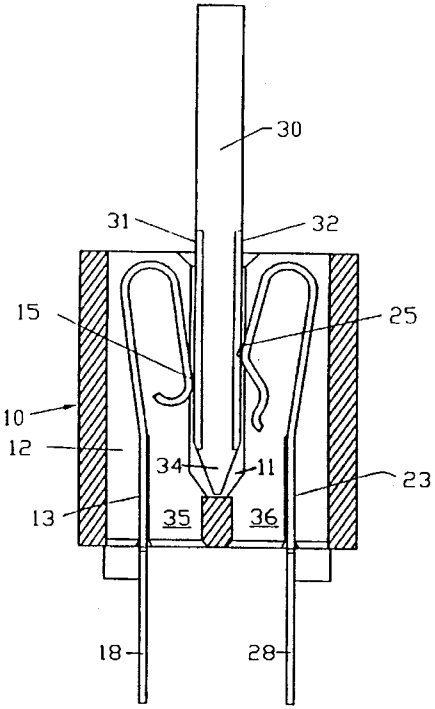
FIG. 3 is a side elevation cut-away view of an electronic module socket after insertion of an electronic module.

FIG. 3 shows the electronic module 30 in its fully inserted position within electronic module socket 10. Upon complete insertion, the first conductive surface 31 is contacted by first module contact area 15 of first contact 13. Second conductive surface 32 is contacted by second module contact area 25 of second contact 23. Tail sections 18 and 28 of first and second contacts 13,23, respectively, protrude from the base of the insulator 12 and connect the conductive areas 31,32 of the electronic module 30 through the contacts 13,23 to a motherboard (not shown) to which the electronic module socket 10 is mounted. In a preferred embodiment, the contact tails 18,28 are throughboard mounted and soldered to the motherboard. In an alternative embodiment, the contact tails may be oriented for surface mounting.

It can be seen that the first module contact area 15 makes contact with conductive area 31 at a position lower than the position at which the second module contact area 25 abuts conductive section 32. Due to the shape of the contacts, in order to provide an automatic wiping action, the module contact areas 15,25 of the contacts are off-set and not uniformly oriented directly across from one another. Due to the off-set module contact areas 15,25, the contacts 13,23 are mounted alternatingly within the insulator 12. Multiple contacts are mounted along a first side 35 of the insulator 12 and a second side 36. The contacts are mounted alternatingly along the first side 35 so that a first contact 13 is next to a second contact 23 which is next to a first contact 13 and so on. On the second side 36 of the insulator 12, a second contact 23 is mounted correspondingly and across from a first contact 13 on the first side 35. Next to the second contact 23 is mounted a first contact 13 and next to that contact is mounted a second contact 23, and so on. This alternating arrangement of contact pairs will ensure that the offset module contact areas 15,25 do not force the electronic module 30 to tilt in either direction within the electronic module socket 10. This high/low, low/high alternating orientation of board contact areas 15,25 of the contacts 13,23 along the first and second sides 35,36 of the insulator ensure that the electronic module 30 will stand straight up in a parallel plane to the insulator walls of the elongated central cavity 11.

A further improvement of this invention is the production of the contacts on a single progressive die which forms the first contact shape 13 and second contact shape 23 simultaneously on a single chain of contacts. This allows for gang loading of an entire side of contacts on the first side or second side 35,36 of the insulator in one operation. The single progressive die allows for the production of these nonuniform contacts twice as fast as opposed to two separate progressive dies.

Once the electronic module 30 is removed from the electronic module socket 10, the contacts 13,23 regain contact at their terminal sections 16,26 (FIG. 1). It is common for this cycle of insertion and removal of a circuit board from the electronic module socket 10 to occur in excess of 400 repetitions. In prior electronic module sockets this high number of cycles caused build-up of sufficient glass flakes from the electronic module 30 to inhibit the electrical connection between the first contact 13 and second contact 23. Specifically, the build-up of debris is likely to occur at first and second module contact areas 15,25. Due to the shape of the contacts 13,23, the terminal sections 16,26 are only secondary areas where debris may build-up. Thus, the first improvement of this invention is the shape of the contacts 13,23 having the terminal sections 16,26 separate from the module contact areas 15,25. This ensures a clean shorting area. The module contact areas 15,25 intercept the module first and upon complete insertion of the module, the terminal sections/short out connection areas 16,26 are pushed away from and external to the elongated central cavity 11 and avoid contact with the chamfered edge 34 of electronic module 30. The second means of ensuring a clean shorting area is the nonuniform automatic wiping shape of the terminal sections 16,26 of the contacts 13,23.

Figure 4:
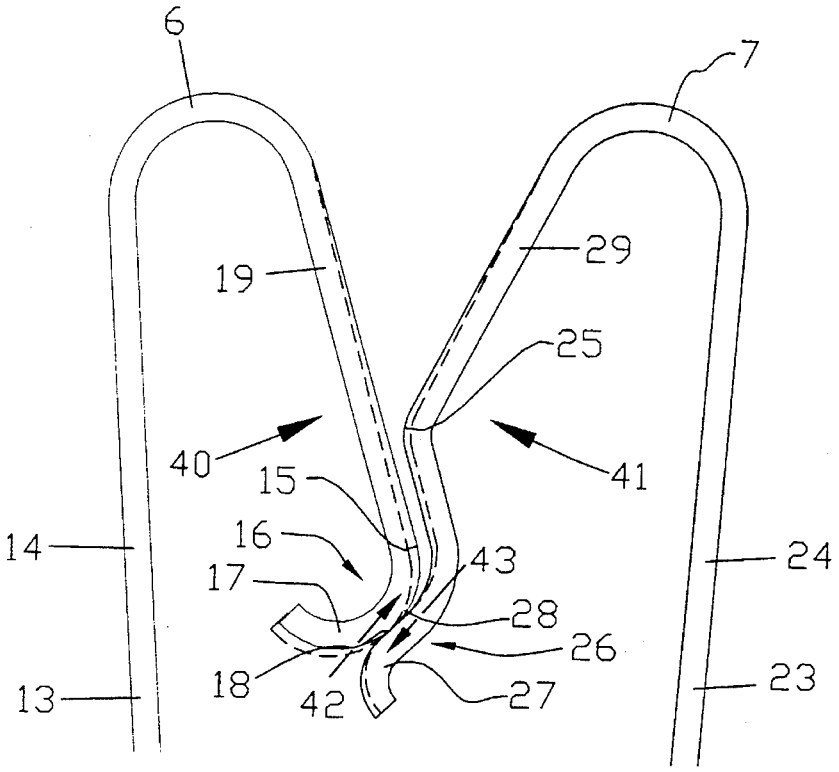
FIG. 4 is an enlarged side view of the contacts of an electronic module socket.

FIG. 4 shows a magnified view of the improved contact shape of the terminal ends 16,26 of first contact 13 and second contact 23, respectively. FIG. 4 shows the contacts 13,23 after the electronic module is removed. The phantom outline depicts the contacts 13,23 just after removal of the module and the solid line indicates the location of the contacts 13,23 a moment later completely mated.

First contact 13 includes a first mast section 14 which is connected to a turn back loop section 6, which is connected with first module contact area 15, which is connected to semi-circle section 17 of the terminal section 16. The second contact 23 includes mast section 24 connected with turn back loop section 7, which is connected with second module contact area 25, which is connected to the J-shaped section 27 of the terminal section 26. J-section 27 of second contact 23 includes flat surface 28 at which sliding contact is made with an apex section 18 of the semi-circle area 17 of first contact 13. The terminal section 16 of first contact 13 is connected to turn back loop section 6 via intermediate section 19. The J-shaped section 27 of second contact 23 is connected to the turn back loop section 7 via intermediate section 29.

Upon removal of a circuit board from between first contact 13 and second contact 23, intermediate section 19 moves in direction of arrow 40 and intermediate section 29 of second contact 23 moves in direction of arrow 41. The turn back loop sections 6,7 which act as spring members cause the intermediate sections 19,29 to spring back toward each other upon removal of the module. As the intermediate sections 19,29 move in direction of arrows 40,41, respectively, the terminal sections 16,26 of the contacts 13,23 also move in correspondence with each other. Apex section 18 of the first contact 13 move in direction of arrow 42 while simultaneously, flat portion 28 of second contact 23 moves in direction of arrow 43. Due to the nonuniform shape of the terminal sections 16,26 of the contacts 13,23, a sliding movement is set up at the terminal sections 16,26. This movement provides an automatic wiping area between the terminal sections 16,26 of the first contact 13 and second contact 23. The self-cleaning wiping action between the flat section 28 of the second contact 23 and the apex section 18 of first contact 13, removes any glass flakes or debris which may gather on the surface of the contacts 13,23. The wiping action of the terminal sections 16,26 assures that uninhibited contact is maintained and that a short out between the contacts 13,23 will occur at this short out connection area.

A normal force between terminal sections 16,26 is reached which is great enough to maintain a gap between module contact areas 15 and 25. The maintaining of the gap is required so that the collection of debris cannot prohibit the wiping motion and shorting connection at terminal sections 16,26.

The shape of the contacts having the terminal sections 16,26 separate and removed from the board contact sections 15,25 also limits the amount of glass flakes which gather at the short out terminal section 16,26.

Figure 5:
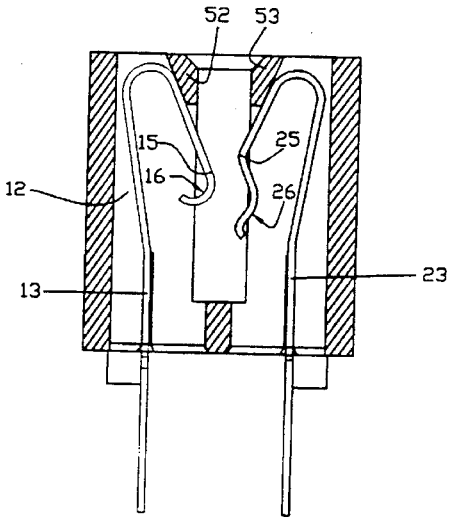
FIG. 5 is a side elevation cut-away view of an alternative embodiment of an electronic module socket.

FIG. 5 discloses an alternative embodiment of an electronic module socket including retention members 52,53 which act to retain contacts 13,23 from shorting out. The retention members 52,53 in a preferred alternate embodiment may be molded integrally with the insulator 12 and act to prohibit terminal sections 16,26 from contacting each other and shorting out. However, upon insertion of an electronic module the contacts 13,23 operate as discussed above, by having module contact sections 15,25 making electrical contact with the conductive surfaces of the electronic module. This alternative embodiment is useful in providing a simple, cost-effective method of providing either an entire electronic module socket or only a portion of an electronic module socket having nonshorting contacts, without having to use differently shaped contacts. Therefore, by addition of the retention members 52,53 to the insulator 12 the contacts 13,23 shaped to be shorting contacts act as nonshorting contacts.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

What is claimed is:

1. An electronic module socket for interconnecting an electronic module to a circuit board, the electronic module socket comprising:

an elongated insulative housing including, an elongated central cavity for receiving an electronic module having;

a plurality of opposed contacts located along both sides of said central cavity configured to establish electrical contact with said electronic module upon insertion of said electronic module within said central cavity;

first and second contacts being correspondingly and nonuniformly shaped in order to provide a short out connection area; and wherein self-cleaning of said short out connection area occurs as said first and second contacts move directly towards one another.

2. The electronic module socket of claim 1 wherein:

said first contact includes a semi-circular section having an apex point; said second contact having a J-shaped section having a flat area; and upon removal of a module from said central cavity, said apex point slides against said flat portion.

3. The electronic module socket of claim 1 wherein:

said first contact includes a first module contact area;

a second module contact area of said second contact; and said first module contact area off-set from said second module contact area.

4. The electronic module socket of claim 1 wherein:

said first and second contacts including terminal sections providing a wiping motion.

5. The electronic module socket of claim 1 wherein:

said first contact includes a turn back loop section and a first mast section; and said second contact, includes a turn back loop section and a second mast section.

6. The electronic module socket of claim 1 wherein said first and second contacts are alternately mounted along each side of said central cavity.

7. The electronic module socket of claim 1 wherein said first and second contacts include contact tails for through-board insertion.

8. The electronic module socket of claim 1 wherein said first and second contacts include contact tails for surface mounting.

9. The electronic module socket of claim 1 wherein said insulative housing includes retention members for prohibiting said contacts from shorting out.

10. An electronic module socket insulator comprising:

a first contact having a terminal end;

a second contact having a terminal end;

said terminal ends of said first and second contacts providing for an automatic wiping motion upon removal of a module from between said contacts, said automatic wiping motion occurring as said first and second contacts move directly towards one another; and said first and second contacts manufactured via a single progressive die.

11. The electronic module socket insulator of claim 10 wherein:

said first and second contacts are generated in a progression corresponding to the socket insulator so that said first and second contacts may be gang loaded.

12. An electronic module socket for interconnecting an electronic module to a circuit board, the electronic module socket comprising:

an elongated insulative housing including, an elongated central cavity for receiving an electronic module having;

a plurality of opposed contacts located along both sides of said central cavity configured to establish electrical contact with said electronic module upon insertion of said electronic module within said central cavity;

first and second contacts having a means for providing a short out connection area;

terminal section of said contacts not contacting said module upon its insertion within said central cavity; and wherein self-cleaning of said short out connection area occurs as said first and second contacts move directly towards one another.

13. An electronic module socket for interconnecting an electronic module to a circuit board, the electronic module socket comprising:

an elongated insulative housing including, an elongated central cavity for receiving an electronic module having;

a plurality of opposed contacts located along both sides of said central cavity configured to establish electrical contact with said electronic module upon insertion of said electronic module within said central cavity;

first and second contacts being correspondingly and non-uniformly shaped in order to provide a short out connection area;

short out connection area of terminal sections of said contacts not contacting said module upon its insertion within said central cavity; and wherein self-cleaning of said short out connection area occurs as said first and second contacts move directly towards one another.

14. The electronic module socket of claim 13 wherein:

said contacts include a terminal section positioned away from the plane of insertion of said module.

15. The electronic module socket of claim 13 wherein:

a first contact includes a semi-circle area;

an intermediate area;

said semi-circle area in a non-linear orientation from said intermediate area;

a second contact includes an intermediate area and J-shaped section; and said J-shaped section in a non-linear orientation from said intermediate area.

* * * * *